US005769022A

United States Patent [19]

Luxford

[11] Patent Number: 5,769,022

[45] Date of Patent: Jun. 23, 1998

[54] CANOPY FOR FLOAT TUBE

[76] Inventor: Timothy Luxford, 3511 Carlisle Street, Coquitlam, British Columbia, Canada, V3J 4M1

[21] Appl. No.: 764,297

[22] Filed: Dec. 12, 1996

[51] Int. Cl.[6] ..... B63B 17/00

[52] U.S. Cl. ..... 114/361; 114/345

[58] Field of Search ..... 114/345, 346, 114/343, 361; 441/129–132, 35, 38, 40; 135/20.2, 88.01, 88.03, 88.13, 90, 96, 97, 127, 143, 116, 117; D12/317

[56] References Cited

U.S. PATENT DOCUMENTS

| | | | |
|---|---|---|---|
| 1,746,833 | 2/1930 | Hermansen | 135/90 |
| 2,010,371 | 8/1935 | Perri | 441/130 |
| 4,706,696 | 11/1987 | Gillis | 135/127 |
| 4,865,381 | 9/1989 | Van Rogue | 136/96 |
| 5,168,889 | 12/1992 | Diestel | 135/88.01 |
| 5,203,363 | 4/1993 | Kidwell et al. | 135/90 |
| 5,403,220 | 4/1995 | Goad, Sr. | 441/130 |

*Primary Examiner*—Ed L. Swinehart
*Attorney, Agent, or Firm*—Norman M. Cameron

[57] ABSTRACT

A float tube canopy includes a back panel having a top and a bottom with straps for securing the canopy to the back of a float tube so the back panel extends upwardly therefrom. There is a top panel having a front and a back connected to the top of the back panel. The top panel is cantilevered from the back panel and spaced-apart from the float tube. Each of the panels may include a frame and a fabric cover stretched thereon. The panels may be collapsible so the canopy can be selectively folded or erected.

13 Claims, 5 Drawing Sheets

CANOPY FOR FLOAT TUBE

BACKGROUND OF THE INVENTION

This invention relates to canopies for small water craft, particularly float tubes or belly boats.

Float tubes are commonly used by fishermen for fishing in relatively calm, shallow waters near shore. The fishermen can fish significantly further from shore with these devices; than possible using hip waders and walking on the bottom. These water craft are the equivalent of inner tubes with a supporting harness which keeps a fisherman inside, while the fisherman's hip waders project downwardly from the bottom of the float tube.

These devices however provide little shelter in the exposed environment encountered by fishermen offshore. Fishermen are then subjected to wind, sun, rain and cold depending upon the particular climate and weather.

It has been recognized in the past that it would be desirable to provide a canopy or other cover for fishermen using float tubes to give protection against the elements. However such covers have not been widely accepted because of inherent problems. To be acceptable, such covers must be easily erected and should not interfere unduly with the use of a fishing rod.

For this reason they should provide as much open area beneath the cover as possible, particularly on the sides.

SUMMARY OF THE INVENTION

It is therefore an object of the invention to provide an improved canopy for float tubes which can be easily connected to a standard float tube.

It is another object of the invention to provide an improved canopy for float tubes which is cantilevered from the back of the float tube such that the sides are open under the canopy so as not to interfere with use of a fishing rod.

It is a further object of the invention to provide an improved canopy for float tubes which can be easily collapsed or erected as desired by the fishermen either while in the float tube or outside it.

It is a still further object of the invention to provide an improved canopy for float tubes which is simple and rugged in construction and economical to produce and sell.

In accordance with these objects there is provided a float tube canopy for a float tube having a back and a front. The canopy comprises a back panel having a top and a bottom panel with means for securing the canopy to the back of the float tube so the back panel extends upwardly therefrom. There is a top panel having a front and a back connected to the top of the back panel. The top panel is cantilevered from the back panel and spaced-apart from the float tube.

Preferably each of the panels comprises a frame and a fabric cover stretched thereon.

Each of the panels may have opposite sides. Each frame includes elongated rigid members extending along the sides of each panel, along the bottom of the back panel and along the top of the top panel. The frame of the top panel and the frame of the back panel may be connected together by elbows. The frames may be releasably connected to the elbows.

Preferably the rigid members along the sides of the back panel are pivotally connected to the rigid member along the bottom thereof and the rigid members along the sides of the top panel are pivotally connected to the rigid member along the front thereof so the frames can be folded.

Preferably the means for securing includes straps. There may be straps near each side of the back panel near the bottom thereof. Each strap has an end distal the back panel with means for connecting each strap to a ring on the float tube. There may also be a third strap near the bottom of the back panel midway between the straps near each side thereof.

Canopies according to the invention offer significant advantages to the fishermen and other users of float tubes. They can be quickly attached to standard float tubes by means of the common D-rings connected to the tubes at the back and sides thereof. These canopies can be raised or lowered as required by the fishermen according to conditions. Furthermore, the sides of the float tube are not encumbered by supports which would hinder the use of a fishing rod or the visibility of the fishermen. The canopy is supported entirely from the back of the float tube and cantilevers over a fisherman's head. The structure is light, but strong and can be produced and sold for a reasonable price.

DESCRIPTION OF THE PREFERRED EMBODIMENTS

Figure 1:
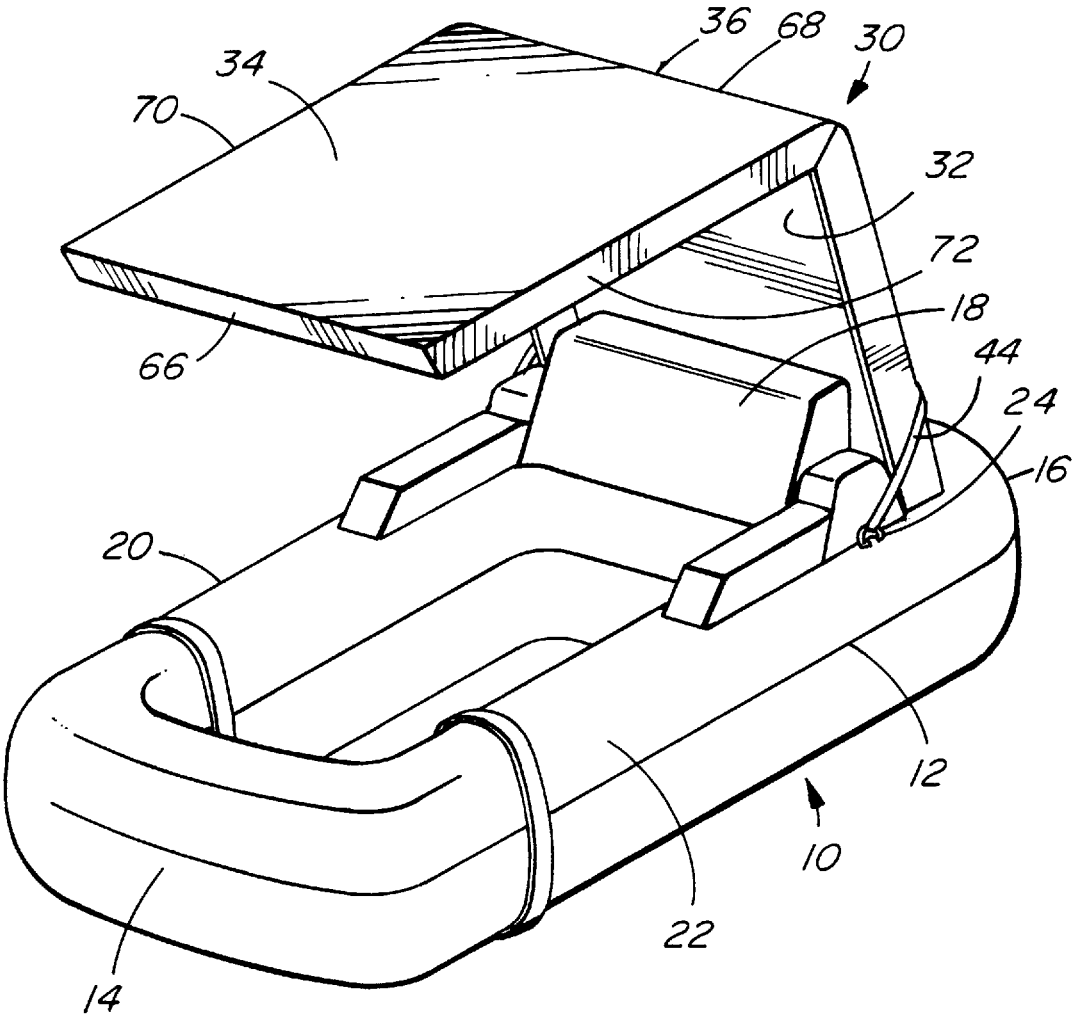
FIG. 1 is a top, front isometric view of a float tube with a canopy according to an embodiment of the invention mounted thereon.
Figure 2:
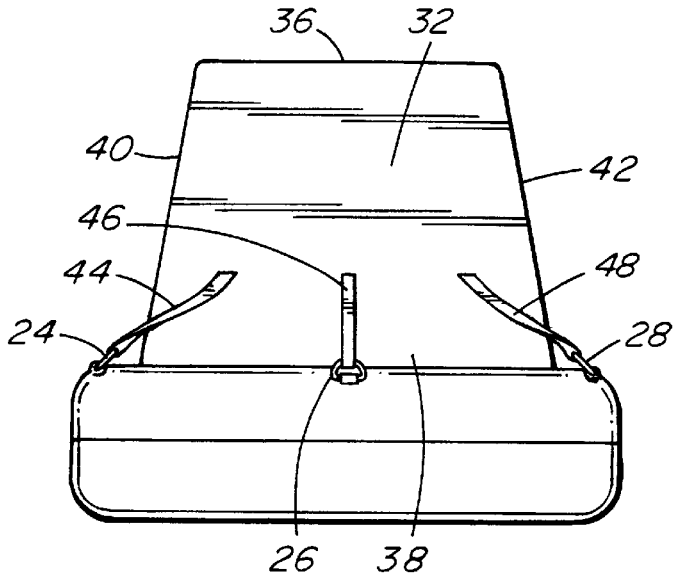
FIG. 2 is a rear elevation thereof.

Referring to the drawings, and first to FIG. 1, this shows a conventional float tube 10 which includes an annular inflatable tube 12, typically of a synthetic elastomeric material. The float tube has a front 14, a back 16 provided with an inflatable back rest 1 8, and sides 20 and 22. The float tube is provided with a series of D-rings about the periphery thereof for attaching accessories. Three such rings 24, 26 and 28 are shown in FIG. 1 and 2. D-rings 24 and 28 are on the sides of the float tube adjacent the back and ring 28 is at the back midway between the rings 24 and 28. This is a conventional arrangement although the invention can be altered to fit other arrangements of rings or may be secured to the float tube in other manners besides the rings.

Figure 5:
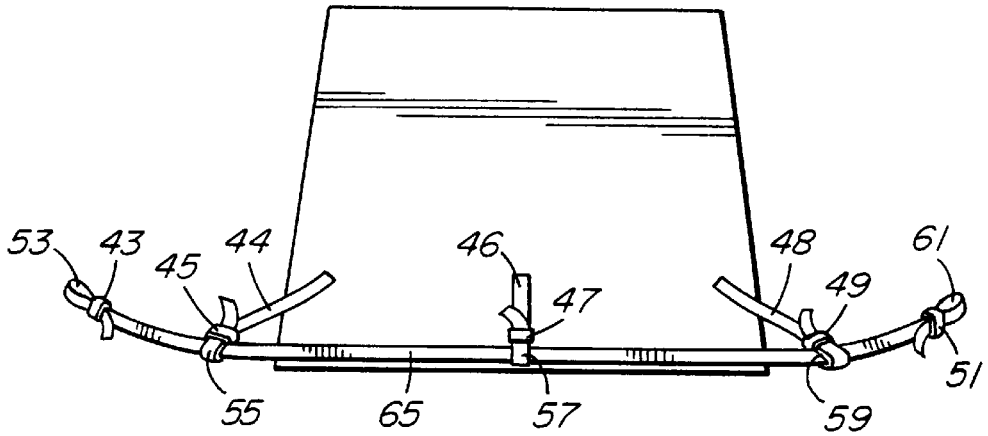
FIG. 5 is a rear elevation thereof.
Figure 9:
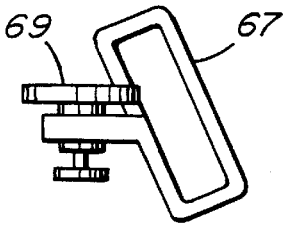
FIG. 9 is a side elevation a strap connector.

Canopy 30 is fitted on the float tube 10 and has a back panel 32 and a top panel 34. The back panel has a top 36, a bottom 38, shown in FIG. 2, and sides 40 and 42. The bottom has means for securing the canopy to the back of the float tube so the back panel extends upwardly therefrom as seen in FIG. 1. This means includes three straps 44, 46 and 48, of nylon in this example, shown best in FIG. 2. Each of the straps has an end distal the canopy provided with means for connecting each strap to one of the rings on the float tube. In this case the means on each strap includes safety buckles 43, 45, 47, 49 and 51 and loops 53, 55, 57, 59, and 61 in the straps shown in FIG. 5. Loops 53 and 61 of strap 65 are connected to D-rings. Alternatively a strap fastener 67 and a universal button assembly 69, shown in FIG. 9, can be used for float tubes without D-rings.

Top panel 34 has a front 66, a back 68 and sides 70 and 72. The top panel is cantilevered from the back panel as seen in FIG. 1. Back 68 of the top panel is connected to the top 36 of the back panel. As may be seen in drawing, the top panel is spaced-apart vertically from the float tube so as to be substantially open from the back panel 32 forwards.

Figure 11:
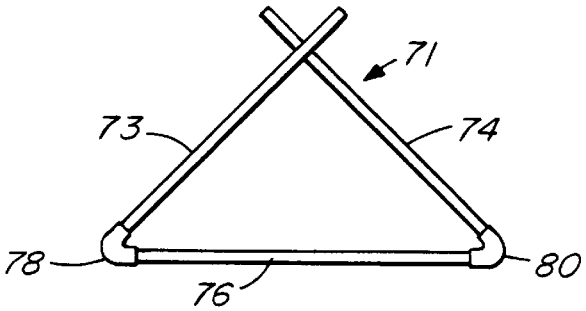
FIG. 11 is a view similar to FIG. 8 of the frame members for the back panel.

Each of the panels 32 and 34 includes a frame. Frame 71 of the back panel, shown in FIG. 6, 8, and 11, includes semi-elongated semi-rigid members in the form of rods 73 and 74 along the sides 42 and 40 respectively and similar member 76 along bottom 38. As seen in FIG. 11, the members along the sides are connected to the member along the bottom by flexible tubes 78 and 80, of surgical neoprene tubing in this example, which permit the members 72 and 74 to be pivoted from the position shown in FIG. 6, where they are parallel to the sides 42 and 40 of the panel, to the position shown in FIG. 11 and further until the members 72 and 74 are along side member 76. In this embodiment the members 73, 74 and 76 are of graphite fiber reinforced polymer although aluminum alloy tubing or other materials could be substituted. Generally they are similar to rods used for erecting tents. They are rigid though flexible and preferably should be shock-corded together as, in this embodiment.

Figure 7:
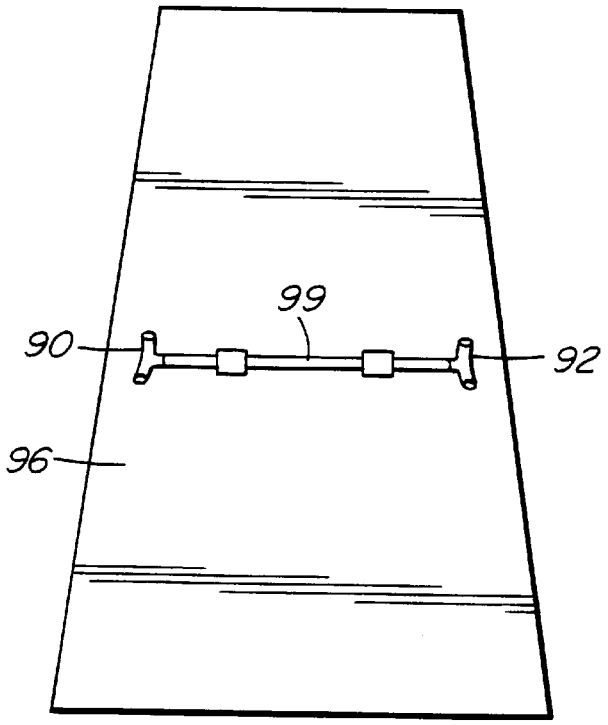
FIG. 7 is a simplified view similar to FIG. 6 showing the spread rod and elbows at each end thereof.
Figure 8:
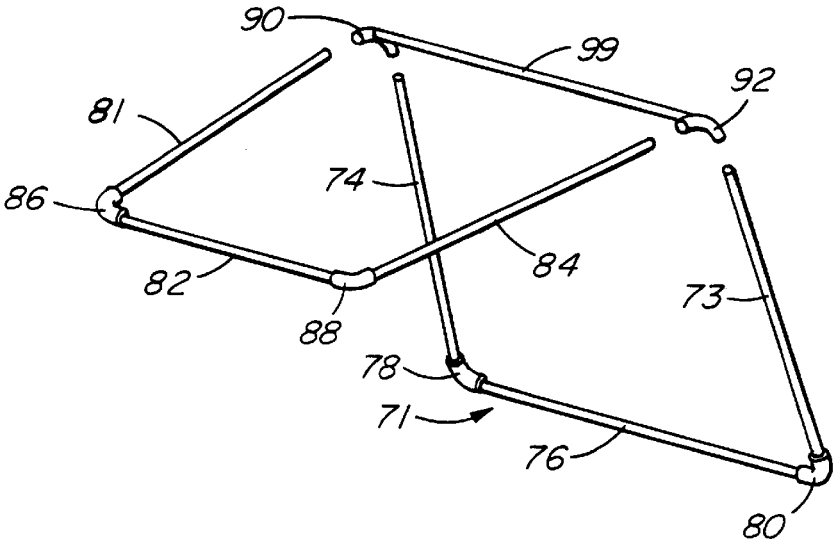
FIG. 8 is an exploded isometric view of the frame.
Figure 10:
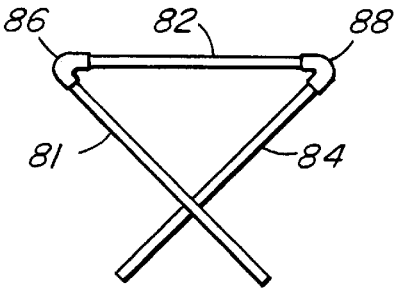
FIG. 10 is a front elevation of the frame members of the top panel connected together and partly folded.

The top panel 34 has similar members 80, 82 and 84, of glass fiber reinforced polymer in this example, which are also pivotally connected together by flexible elbows 86 and 88. Thus the members can be folded in a manner similar to the frame of panel 34 as seen in FIG. 10. The two frames are connected together by rigid elbows 90 and 92, of steel in this example, as shown in FIG. 7 and 8. The members 72, 74, 80 and 84 are inserted into the elbows to the connect the frames together so that the top panel 34 is substantially horizontal when the back panel 34 is substantially vertical as shown in FIG. 1.

Figure 4:
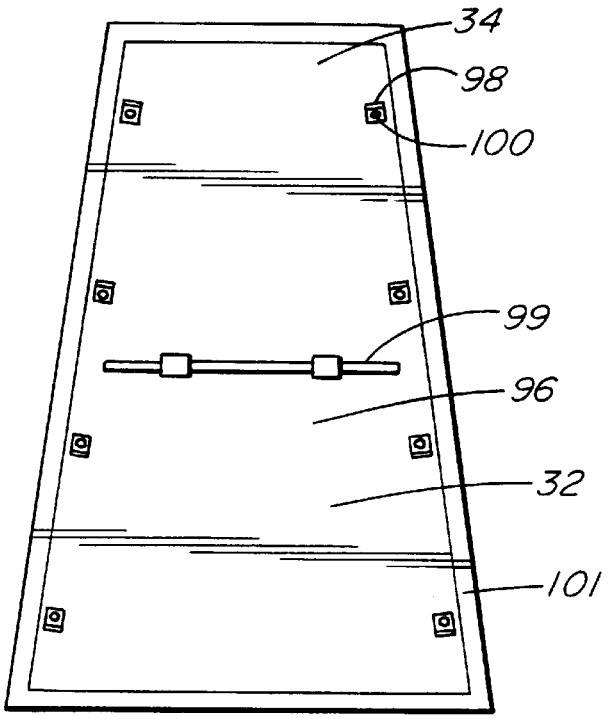
FIG. 4 is an unfolded front elevation of the canopy with the frame members removed.
Figure 6:
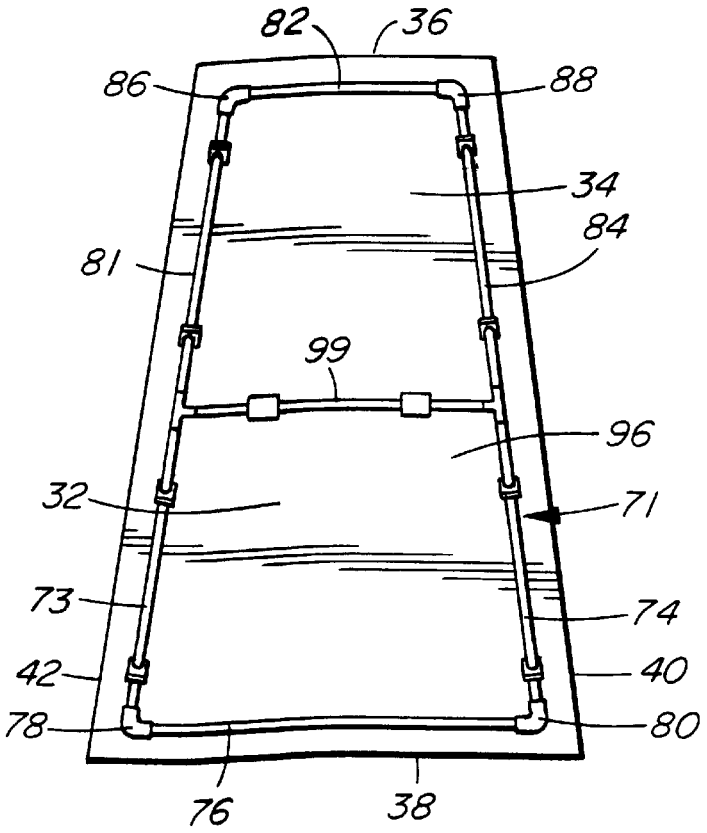
FIG. 6 is a view similar to FIG. 4 with frame members installed.

Each of the panels includes a cloth cover. In this instance there is a single cloth cover 96, best shown in FIG. 4 and 6, covering both of the panels 32 and 34. The cover is of coated nylon in the illustrated embodiment and has a plurality of cloth tabs 98 spaced-apart about the periphery thereof and on the inside of the canopy. Each tab has an eyelet 100. The, tabs and eyelet receive the elongated members or rods 72, 74, 80 and 84 comprising the frames as best seen in FIG. 6. Thus the covers for the frames are stretched over the frame. A spread rod 99 is sewn into the cover 96, coinciding with the back of the top panel and the top of the back panel. The rod 99 is also inserted into sockets in elbows 90 and 92 as seen in FIG. 7. There is a hem 101 extending around the cover. Rods 82 and 76 extend through the hem at the front of the top panel and the bottom of the back panel respectively.

The canopy is installed on the float tube by securing the bottom 38 of the back panel on the back 16 of the float tube about inflatable back rest 18. The straps 44, 46 and 48 are secured to the D-rings 24, 26 and 28 of the float tube. The straps are then tightened so that the member 76 at the bottom of the back panel is snugged securely against the back of the float tube and is curved slightly about the back of the back rest. This curving of the member increases the rigidity of the canopy and permits the cantilevering of the canopy over the float tube as shown in FIG. 1 while preventing the canopy from flipping backwards.

Figure 3A:
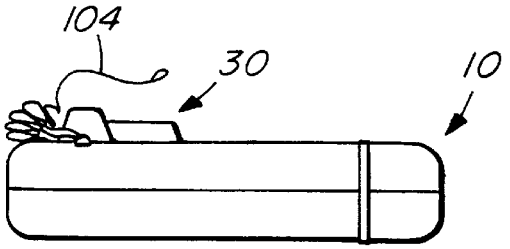
FIG. 3*a*–3*c* are side elevations thereof showing the canopy completely collapsed, partially unfolded and fully erected respectively.
Figure 3B:
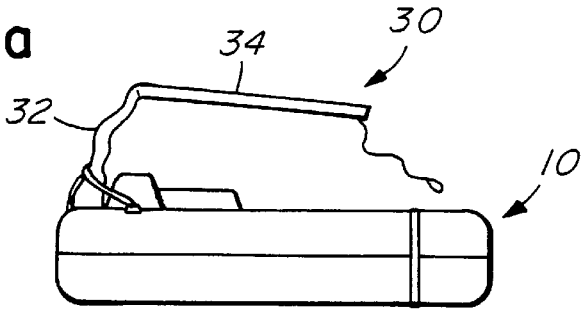
Figure 3C:
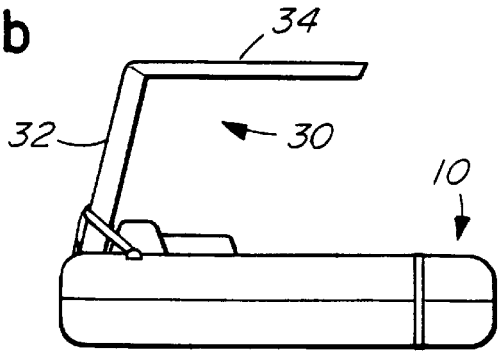

The canopy can be collapsed when not required as shown in FIG. 3*a*. This is accomplished by separating the frames at the elbows 90 and 92 as shown in FIG. 6, 8, 10 and 11 and folding the frames as shown in FIG. 10 and 11 until the canopy is in the collapsed position of FIG. 3*a*. There is a cord 104 connected to the from 66 of the top panel 34 to aid in erection of the canopy. The user simply pulls on the cord and the canopy unfolds as shown in FIG. 3*b* and 3*c* until it is in the erect position and cantilevered over the fishermen and the top of the float tube. The eyelets 100 slide along the rods 73, 74, 80 and 84 as the canopy is erected or collapsed. The fishermen secures the members 73, 74, 80 and 84 of the frames together at elbows 90 and 92 to maintain the top panel in the required horizontal, cantilevered position.

As may be seen in FIG. 1, there are no members or other obstructions between the top panel of the canopy and the top of the float tube from the back panel forwards. Thus the fishermen has a substantially unobstructed view to the sides and clearance for a fishing rod to cast a fall 180° from side to side.

It will be understood by someone skilled in the art that many of the details provided above are by way of example only and are not intended to limit the scope of the invention which is to be interpreted with reference to the following claims.

What is claimed is:

1. A float tube canopy for a float tube having a back and a front, the canopy comprising:

a back panel having a top and a bottom with means for securing the canopy to the back of the float tube so the back panel extends upwardly therefrom, the means for securing including straps, one said strap being near each side of the back panel near the bottom thereof, each said strap having an end distal the back panel with means for connecting said each strap to a ring on the float tube; and a top panel having a front and a back connected to the top of the back panel, the top panel being cantilevered from the back panel and spaced-apart from the float tube.

2. A canopy as claimed in claim 1, wherein each of the panels comprises a frame and a fabric cover stretched thereon.

3. A canopy as claimed in claim 2, wherein said each panel has opposite sides, the frame including elongated members extending along the sides of said each panel, along the bottom of the back panel and along the front of the top panel.

4. A canopy as claimed in claim 3, wherein the frame of the top panel and the frame of the back panel are connected together by rigid elbows.

5. A canopy as claimed in claim 4, wherein at least one of the frames is releasably connected to the elbows.

6. A canopy as claimed in claim 5, wherein the members along the sides of the back panel are pivotally connected to the member along the bottom thereof and the members along the sides of the top panel are pivotally connected to the member along the front thereof, whereby the frames can be folded.

7. A canopy as claimed in claim 6, wherein the members are pivotally connected by sections of flexible tubing.

8. A canopy as claimed in claim 1, wherein the means for connecting is a loop.

9. A canopy as claimed in claim 1, further including a third strap near the bottom of the back panel midway between said straps near each said side thereof.

10. A canopy as claimed in claim 1, wherein the panels are collapsible, whereby the canopy can be selectively folded or erected.

11. A canopy as claimed in claim 1, wherein the canopy is open between the top panel and the float tube from the back panel forwards.

12. A canopy as claimed in claim 3, wherein the elongated member along the bottom of the back panel is bendable.

13. A canopy as claimed in claim 3 including an elongated member along the top of the back panel.

* * * * *